United States Patent [19]

Hertel et al.

[11] 4,115,910

[45] Sep. 26, 1978

[54] ROLLER REINFORCED WITH A HARD METAL JACKET

[76] Inventors: Günther Hertel, Weissenseestrasse 9, D-8500, Nurnberg; Karl Gustav Hertel, Espanstrasse, 6, D-8510 Fürth, both of Fed. Rep. of Germany

[21] Appl. No.: 791,297

[22] Filed: Apr. 27, 1977

[30] Foreign Application Priority Data

Jul. 2, 1976 [DE] Fed. Rep. of Germany ..... 2629802

[51] Int. Cl.[2] ..... B21B 27/02

[52] U.S. Cl. ..... 29/123; 29/125

[58] Field of Search ..... 29/123, 125, 129.5

[56] References Cited

U.S. PATENT DOCUMENTS

| | | | |
|---|---|---|---|
| 1,863,816 | 6/1932 | Von Webern et al. | 29/123 UX |
| 3,461,527 | 8/1969 | Strandell | 29/123 |
| 3,577,619 | 5/1971 | Strandell | 29/125 X |
| 3,667,096 | 6/1972 | Edsmar | 29/125 |
| 3,995,353 | 12/1976 | Wilson | 29/125 X |

*Primary Examiner*—Dorsey Newton

*Attorney, Agent, or Firm*—Spencer & Kaye

[57] ABSTRACT

Hot working roller reinforced with a working jacket of hard metal or the like, the jacket being prestressed in the direction of the roller axis by a clamping force acting via clamping rings presenting clamping surfaces inclined with respect to the roller axis, with the jacket being separated from the roller body by an annular gap having a height such that during use of the roller the outer surface of the roller body remains out of contact with the inner surface of the jacket over the entire intended operating temperature range of the roller, and the clamping surfaces being inclined in a direction such that the clamping force acting on the jacket presents a radially outwardly directed component.

3 Claims, 3 Drawing Figures

ROLLER REINFORCED WITH A HARD METAL JACKET

BACKGROUND OF THE INVENTION

The present invention relates to a roller, particularly a hot roller, which is reinforced with a working jacket of a hard metal or the like, and particularly a roller in which the working jacket is prestressed by a compression pressure applied in the direction of the longitudinal axis of the roller via clamping rings which have clamping surfaces that are arranged at an angle with respect to the roller body, and the working jacket and roller body being separated by an annular gap of sufficient height to prevent the facing peripheral surfaces of the jacket and the roller body from coming into contact with one another during operation of the roller.

German Patent Application No. P 2,618,884.1 filed on Apr. 29, 1976, and a corresponding U.S. application, Ser. No. 791,299, filed by Heinz Zimmermann and Wolfgang Martens on Apr. 27, 1977, entitled PROCESSING ROLLER HAVING REINFORCING JACKET OF HARD METAL, and claiming the priority of the above-mentioned German application, discloses a roller, particularly a hot roller, which is reinforced with a working jacket of hard metal or the like which is compressively prestressed by pressure in the direction of the longitudinal axis of the roller via clamping rings which have clamping surfaces that are inclined with respect to the roller axis. That roller is characterized in that a continuous annular gap is disposed between the working jacket and the roller body and has a radial dimension such that during operation of the roller within its design operating temperature range the outer peripheral surface of the roller body and the inner peripheral surface of the working jacket do not contact one another.

The purpose of this arrangement is to isolate the working jacket from the mechanical stresses which are produced during operation of the roller as a result of the roller body being heated and to prevent the working jacket from being torn apart by such stresses. Such an arrangement is advisable, particularly for hot rollers which are heated to higher operating temperatures, since the coefficient of thermal expansion of steel, the material of the roller body, is about $13\text{–}18 \cdot 10^{-6} \cdot \text{degree}^{-1}$ and that of hard metal is about $5\text{–}7.5 \cdot 10^{-6} \cdot \text{degree}^{-1}$.

If, during operation of the roller, the working jacket expands in a radial direction, the clamping bodies which position the working jacket naturally follow this expansion. In order to prevent the working jacket from coming loose, since it does not sit directly on the roller body due to the above-mentioned annular gap, at least one resiliently deformable member is provided in a known manner between the working jacket and an abutment so as to shift the clamping rings in the direction of the longitudinal axis of the roller in correspondence with the expansion of the working jacket.

The structure disclosed in the above-cited applications is based on the assumption that the angle formed between those surfaces of a clamping ring which bear, respectively, against the working jacket and the outer periphery of the roller body, or formed between a surface of the working jacket which bears against a clamping ring and the outer peripheral surface of the working jacket, should invariably be an obtuse angle so that when the roller body expands no additional radially outwardly acting forces are transferred to the working jacket. The reason for this was stated in the above-cited applications to be that hard metal is able to absorb extraordinarily high friction and pressure stresses but, due to its relatively soft cobalt matrix, is less able to support tensile stresses.

The arrangement disclosed in the above-cited applications operates perfectly as long as it is assured that even with the slightest change in the operating temperature the clamping rings are instantaneously adjusted and as long as the force P imposed on the working jacket by the workpiece is not too high. If these conditions are not met, there exists the danger, for example, that, when the temperature of the roller body increases, which is unavoidable during long periods of operation, the clamping effect will lessen and the working jacket will become loose and begin to knock. The result is that the workpieces are rolled to dimensions which are outside the preset tolerance limits and there exists the additional danger that the working jacket might be damaged.

The limits for the roller pressures are determined by the bending elasticity of the working jacket and of the clamping rings. The structure disclosed in the above-cited applications thus makes it necessary that the roller pressures P be transferred around the roller body so that they can be absorbed by the clamping rings only on the side of the roller diametrically opposite the working side. Thus the working jacket is continuously subjected to a milling pressure which, although slight, is tolerable only up to a given maximum roller force P.

SUMMARY OF THE INVENTION

It is an object of the present invention to minimize the danger of loosening of the working jacket with increasing operating temperatures as well as the milling stresses on the working jacket.

This and other objects are accomplished according to the present invention by giving the clamping surfaces of the working jacket and the clamping rings an inclination such that the axial compressive prestress force on the working jacket generates a radial component directed outwardly away from the roller body. It can also be stated that the radial component induces a tensile stress in the working jacket in the direction of the jacket circumference, or that the angle $\beta$ between the clamping surface of a clamping ring and the inner peripheral surface of the ring which contacts the roller body is an acute angle. Correspondingly the identical angle $\beta$ between a clamping surface of the jacket and the outer peripheral surface of the jacket is an acute angle.

Surprisingly, it has been found that the fear expressed in the above-cited applications that the tensile strength of the working jacket made of a hard metal or the like could easily be exceeded has not materialized after all, but that instead the danger of knocking of such working jacket is much greater than that of excessive tensile stresses.

The inclination defining the angle $\beta$ according to the present invention, which differs from that of the above-cited applications, has the particular advantage that the working jacket is urged against the clamping rings in the immediate vicinity of the stresses from the rolling pressure and that, therefore, only a much smaller part of the working jacket is under stress.

The contact area can be designed to produce a particularly force locking effect if the acute angle $\beta$ is made small. An angle of about 45° has been found to be optimum. By his selection of the size of this angle, the designer will moreover be able to adapt the counterforce to be produced by the resiliently deformable members to the anticipated working, or rolling, force.

A further advantage of the configuration for the working jacket according to the present invention is that much less hard metal is required for its manufacture than if the working jacket is designed as proposed in the above-cited applications. This is an important factor since these hard metals are expensive.

DESCRIPTION OF THE PREFERRED EMBODIMENTS

Figure 1:
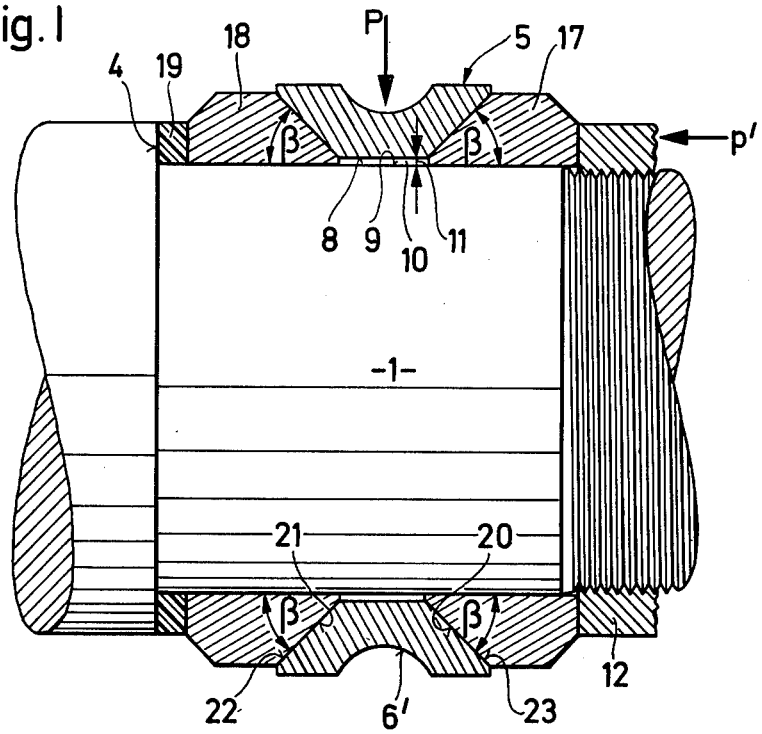
FIG. 1 is a longitudinal, cross-sectional view of a hard metal reinforced hot working roller with semicircular working profile according to a preferred embodiment of the invention.

FIG. 1 shows a roller which includes a roller body 1 mounted on bearing and drive journals (not shown). The roller body 1 is reinforced with a working jacket 5 of hard metal, heat resistant steel, sintered material or the like. In the embodiment shown in FIG. 1 this working jacket has a semicircular rolling profile 6' which is subjected to a rolling force P by the workpiece.

The working jacket 5 is dimensioned so that a continuous annular gap 10 is disposed between its inner peripheral surface 8 and the outer peripheral surface 9 of the roller body 1. The radial height 11 of this annular gap is at least of such a magnitude that during operation of the roller the outer peripheral surface 9 of the roller body 1 and the inner peripheral surface 8 of the working jacket 5 do not come into contact with one another.

In order to keep the working jacket 5 in the illustrated position it is necessary to put it under a compressive prestress in the direction of the longitudinal axis of the roller. This is done with the aid of a clamping device which may, for example, be a screw press or any other commonly used mechanism and which is not shown in the drawing. With this press it is possible to produce an easily adjustable force $p'$ which acts on the working jacket 5 in the direction of the roller longitudinal axis via a clamping disc 17.

The working jacket 5 is pressed against a further clamping disc 18 by the influence of the force $p'$ exerted on it and finally against a resiliently deformable member 19. Member 19 is itself supported against shoulder 4 of the roller body 1.

FIG. 1 shows that the clamping surfaces 20 and 21 of clamping discs 17 and 18 are inclined with respect to the roller body in such a manner that they form an acute angle $\beta$ with the surfaces of the respective discs which contact roller body 1. This makes it possible for the working jacket 5 to be in flush contact with, and supported by, clamping discs 17 and 18 while maintaining the annular gap 10.

If roller body 1 should be heated slightly in the course of the rolling work, it will expand in a radial direction with the result that a slight circumferential pulling force is transmitted to working jacket 5. It has been found, however, that this pulling force will in no case lead to bursting of the working jacket when it is heated to a slight degree compared to the operating temperature since, once a certain level of this force is exceeded, the clamping body 18 can in all cases escape the force of the elastic member 19.

Moreover, the selection of an acute angle $\beta$ makes it possible for the working jacket 5 to be supported already in the immediate vicinity of the working surface by clamping discs 17 and 18, i.e. in the axial region where the rolling force P is effective. The selection of the magnitude of this angle moreover assures that the ratio of the forces P:$p'$ can be set within wide limits. This makes it possible to construct, at relatively low development cost, compensation devices for the rolling force P, which devices are capable of compensating relatively high rolling forces.

Figure 2:
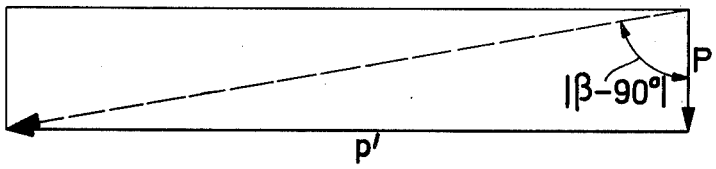
FIGS. 2 and 3 are vector diagrams showing the relationships of the rolling force P to the reaction, or absorbing, force $p'$ which has a component in the direction of the longitudinal axis.

FIG. 2 shows in a schematic manner the dependence of the compensating force $p'$, along the horizontal coordinate axis, on the rolling force P, along the vertical coordinate axis in an arrangement according to the above-cited applications. According to the requirement made there for maintaining an obtuse angle between clamping surfaces 20, 21 and the jacket surface of the roller body, the diagram shows the angle $\beta$-90°, which corresponds to the term "$\beta$" employed in the above-cited applications. The diagram shows that even with this arrangement, the force relationships can be improved in principle by increasing the angle $\beta$. The effectiveness of this increase is limited, however, since due to the selection of an obtuse angle the rolling pressure P must be conducted around the circumference of the roller and can be absorbed only at the diametrically opposite side of the roller. The path of this flow of force is thus relatively long.

Figure 3:
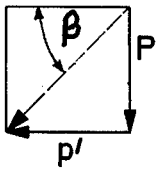

FIG. 3 shows the conditions as they exist according to the present invention. In this case an increase in the size of the acute angle $\beta$ directly reduces the size of the compensating force $p'$, and this force can be easily supported since the path of the flow of forces is short and support is provided in the vicinity of the stressed point.

The "hard metal" employed for the working jacket of rollers according to the invention can be constituted by any suitable one of the known hard metal cemented carbides.

It will be understood that the above description of the present invention is susceptible to various modifications, changes and adaptations, and the same are intended to be comprehended within the meaning and range of equivalents of the appended claims.

What is claimed is:

1. In a hot roller for working material, which roller includes a rotatably mounted roller body, a reinforcing working jacket composed of hard metal and having the form of a hollow cylinder disposed around the roller body, clamping means mounted between the roller body and the jacket and including clamping rings bearing against the axial end surfaces of the jacket and means acting via the rings for applying an axial compressive prestress force to the jacket, the axial end surfaces of the jacket and the clamping ring surfaces which bear thereagainst being inclined with respect to the roller axis, and the roller body and working jacket defining an annular gap between the inner peripheral surface of the working jacket and the outer peripheral surface of the roller body, the dimension of the annular gap in the direction between said jacket and roller body being sufficiently large to maintain the outer peripheral surface of the roller body and the inner peripheral surface of the working jacket out of contact with one another during operation of the roller at temperatures extending over its entire operating temperature range, the improvement wherein the clamping surfaces at opposed ends of said working jacket diverge from one another in the radial direction away from the roller axis.

2. An arrangement as defined in claim 1 wherein the angle between each said clamping surface and the peripheral surface of said roller body is approximately 45°.

3. An arrangement as defined in claim 1 wherein said means acting via said rings comprises a resiliently deformable member which is compressed by the prestress force and acts to urge said rings toward one another.

* * * * *